US009533351B2

(12) United States Patent
Bishop et al.

(10) Patent No.: US 9,533,351 B2
(45) Date of Patent: Jan. 3, 2017

(54) ALUMINUM POWDER METAL ALLOYING METHOD

(75) Inventors: Donald Paul Bishop, Stillwater Lake (CA); Richard L. Hexemer, Jr., Granite Falls, NC (US); Ian W. Donaldson, Jefferson, MA (US); Randy William Cooke, Halifax (CA)

(73) Assignee: GKN Sinter Metals, LLC, Auburn Hills, MI (US)

( * ) Notice: Subject to any disclaimer, the term of this patent is extended or adjusted under 35 U.S.C. 154(b) by 591 days.

(21) Appl. No.: 13/821,161

(22) PCT Filed: Oct. 4, 2011

(86) PCT No.: PCT/US2011/054741

§ 371 (c)(1),
(2), (4) Date: Mar. 6, 2013

(87) PCT Pub. No.: WO2012/047868

PCT Pub. Date: Apr. 12, 2012

(65) Prior Publication Data

US 2013/0183189 A1 Jul. 18, 2013

Related U.S. Application Data

(60) Provisional application No. 61/389,512, filed on Oct. 4, 2010.

(51) Int. Cl.
*B22F 3/12* (2006.01)
*B22F 1/00* (2006.01)
(Continued)

(52) U.S. Cl.
CPC ..... *B22F 1/0003* (2013.01); *B22F 3/12* (2013.01); *B22F 9/082* (2013.01); *C22C 1/0416* (2013.01);
(Continued)

(58) Field of Classification Search
CPC ..... B22F 9/082; B22F 1/0003; B22F 3/12; C22C 21/00; C22C 1/0416
See application file for complete search history.

(56) References Cited

U.S. PATENT DOCUMENTS 2,967,351 A * 1/1961 Roberts et al. ..... 419/38
3,250,838 A 5/1966 Bartoszak
(Continued)

FOREIGN PATENT DOCUMENTS

CN 1628008 A 6/2005
JP S5012368 B1 5/1975
(Continued)

OTHER PUBLICATIONS

The State Intellectual Property Office of the People's Republic of China, First Office Action and Search Report, Application No. 201180047019.6, Jun. 24, 2014, 13 pages [English Language Translation Only].
(Continued)

*Primary Examiner* — George Wyszomierski
*Assistant Examiner* — Ngoclan T Mai
(74) *Attorney, Agent, or Firm* — Quarles & Brady LLP

(57) ABSTRACT

A zirconium-doped aluminum powder metal and a method of making this powder metal are disclosed. The method of making includes forming an aluminum—zirconium melt in which a zirconium content of the aluminum—zirconium melt is less than 2.0 percent by weight. The aluminum—zirconium melt then powderized to form a zirconium-doped aluminum powder metal. The powderization may occur by, for example, air atomization.

13 Claims, 8 Drawing Sheets

(51) Int. Cl.

| | |
|---|---|
| ***B22F 9/08*** | (2006.01) |
| ***C22C 1/04*** | (2006.01) |
| ***C22C 21/00*** | (2006.01) |
| ***C22C 21/10*** | (2006.01) |
| ***C22C 21/12*** | (2006.01) |
| ***C22C 21/16*** | (2006.01) |

(52) U.S. Cl.

CPC ..... *C22C 21/00* (2013.01); *C22C 21/10* (2013.01); *C22C 21/12* (2013.01); *C22C 21/16* (2013.01); *B22F 2998/00* (2013.01); *B22F 2999/00* (2013.01)

(56) References Cited

U.S. PATENT DOCUMENTS

| | | | | |
|---|---|---|---|---|
| 4,502,983 | A | 3/1985 | Omori et al. | |
| 4,629,505 | A * | 12/1986 | Paris | 75/228 |
| 4,690,796 | A * | 9/1987 | Paliwal | 419/12 |
| 4,770,848 | A | 9/1988 | Ghosh et al. | |
| 5,067,994 | A | 11/1991 | Brubak et al. | |
| 5,346,667 | A * | 9/1994 | Kamitsuma | B22F 3/105 419/29 |
| 6,231,808 | B1 * | 5/2001 | Hashikura et al. | 420/528 |
| 2004/0137218 | A1 * | 7/2004 | Liu | B22D 17/007 428/328 |
| 2006/0013719 | A1 * | 1/2006 | Ichikawa et al. | 419/29 |
| 2010/0183471 | A1 * | 7/2010 | Liu | B22F 3/1007 419/37 |

FOREIGN PATENT DOCUMENTS

| | | | |
|---|---|---|---|
| JP | S63290240 | A | 11/1988 |
| JP | H11504388 | A | 4/1999 |
| WO | 98/35068 | A1 | 8/1998 |
| WO | 2009/140726 | A1 | 11/2009 |

OTHER PUBLICATIONS

International Search Report and Written Opinion as mailed on Apr. 18, 2012 for International Application No. PCT/US2011/054741.

The State Intellectual Property Office of the People's Republic of China, Second Office Action, Application No. 201180047019.6, Mar. 9, 2015, 19 pages.

PCT International Preliminary Report on Patentability, PCT/US2011/054741, Apr. 9, 2013, 7 pages.

The State Intellectual Property Office of the People's Republic of China, Third Office Action, Application No. 201180047019.6, Sep. 11, 2015, 23 pages.

The State Intellectual Property Office of the People's Republic of China, Third Office Action and Search Report, Application No. 201180047019.6, Feb. 26, 2016.

Japan Patent Office, Notification of Reasons for Refusal, Application No. 2013-531963, Jul. 7, 2015, 8 pages.

* cited by examiner

ALUMINUM POWDER METAL ALLOYING METHOD

CROSS-REFERENCE TO RELATED APPLICATION

This application represents the national stage entry of PCT International Application No. PCT/US2011/054741 filed on Oct. 4, 2011, and claims the benefit of U.S. provisional patent application No. 61/389,512 filed on Oct. 4, 2010. The disclosure of each of these applications is hereby incorporated by reference as if set forth in their entirety herein.

STATEMENT OF FEDERALLY SPONSORED RESEARCH OR DEVELOPMENT

Not applicable.

BACKGROUND OF THE INVENTION

This disclosure relates to powder metallurgy. In particular, this disclosure relates to powder metal formulations for powder metallurgy.

Powder metallurgy is an alternative to more traditional metal forming techniques such as casting. Using powder metallurgy, parts with complex geometries may be fabricated that have dimensions very close to those dimensions desired in the final part. This dimensional accuracy can save significant expense in machining or reworking, particularly for parts having large production volumes.

Parts made by powder metallurgy are typically formed in the following way. First, a formulation including one or more powder metals and a lubricant material is compacted in a tool and die set under pressure to form a PM compact. This PM compact is then heated to remove the lubricant material and to sinter the individual particles of the powder metal together by diffusion-based mass transport. Sintering is typically performed by heating the powder metal material to a temperature that is either slightly below or above its solidus temperature. When held below the solidus sintering occurs in the absence of a liquid phase. This is commonly referred to as solid state sintering. When held above the solidus, a controlled fraction of liquid phase is formed. Sintering in this manner is known as liquid phase sintering. Regardless of the sintering temperature employed, the sintered part is very similar in shape to the original compact.

During the sintering process, it is common for the parts to shrink dimensionally. As diffusion occurs, adjacent particles will neck into one another to form permanent bonds with one another and to begin to fill any voids between the particles. This densification closes and/or decreases the size of the pores and decreases the overall size of the sintered part in comparison to the compact. Even at long sintering times, however, some voids will remain in the sintered part. Unfortunately, for sintered parts that are less than fully dense, the mechanical strength of those sintered parts are also usually somewhat less than that of a wrought part.

Moreover, in many sintered parts, the shrinkage may be, for any of a number of reasons, different in various directions. This kind of anisotropic shrinkage can alter the dimensional accuracy of the as-sintered final part and, in some cases, may require that parts be reworked after sintering.

Hence, a need exists for improved powder metals. In particular, there has been a continued need for powder metals that, when sintered, have mechanical strength approaching that of their wrought counterparts and that do not exhibit anisotropic shrinkage.

SUMMARY OF THE INVENTION

An improved aluminum powder metal, and a related method of making the powder metal, is disclosed which has reduced distortion during sintering of a part made by the powder metal. The aluminum powder metal reduces the amount of distortion at least in part, by doping the aluminum powder metal with zirconium in a relatively homogenous fashion throughout the powder metal. Further, a formulation of this powder metal composition is disclosed including an amount of tin which provides an improved Young's modulus that, surprisingly and unexpectedly, approaches the Young's modulus of a fully dense material made by casting or the like.

A method of making a powder metal for production of a powder metal part is disclosed. The method includes forming an aluminum—zirconium melt in which a zirconium content of the aluminum—zirconium melt is less than 2.0 percent by weight of the melt. The aluminum—zirconium melt is powderized to form a zirconium-doped aluminum powder metal.

In one form of the method, the step of powderizing may include air atomizing the aluminum—zirconium melt. In other forms of the method, powderizing the aluminum—zirconium melt to form a zirconium-doped aluminum powder metal may include atomizing with gases other than air (such as, for example, nitrogen, argon, or helium), comminution, grinding, chemical reaction, and/or electrolytic deposition.

A powder metal part may be formed from the zirconium-doped aluminum powder metal. A quantity of zirconium in the powder metal part may be substantially equal to a quantity of zirconium found in the zirconium-doped aluminum powder metal used to form the powder metal part, meaning that little or no zirconium is added by an elemental powder or as part of a master alloy. The zirconium-doped aluminum powder metal may inhibit distortion of the powder metal part during a sintering process used to form the powder metal part. The powder metal part may include zirconium in an amount of less than 2.0 weight percent.

The zirconium-doped aluminum powder metal may be mixed with other powder metals to provide at least one other alloying element. By mixing the zirconium-doped aluminum powder metal with another powder metal, a mixed powder metal is formed which then can be used to form the powder metal part.

In one form, the other powder metal may include tin as an alloying element. This tin may be added as an elemental powder to the zirconium-doped aluminum powder metal or be prealloyed as part of a master alloy. The tin may be approximately 0.2 percent by weight of the mixed powder metal. A powder metal part made from the mixed powder metal with approximately 0.2 weight percent tin is shown to have a Young's modulus above 70 GPa and approaching 80 GPa. A Young's modulus of this value is comparable to that of a full dense part made by traditional metal forming processes such as casting.

A powder metal made by the above-stated methods is also disclosed. The powder metal is a zirconium-doped aluminum powder metal in which the zirconium is homogenously dispersed throughout the zirconium-doped aluminum powder metal and, further, in which the zirconium-doped aluminum powder metal contains less than 2.0 weight percent zirconium.

In some forms of the powder metal, the powder metal may contain approximately 0.2 weight percent tin as an elemental powder or prealloyed.

Additionally, the zirconium-doped aluminum powder metal may be formed by air atomization or by the other forms of powderization described herein.

In some forms, the powder metal may include a percentage of fines effective to further enhance the dimensional stability of a part made from the powder metal. In one embodiment, the weight percentage of fines may exceed 10 weight percent of the powder metal.

These and still other advantages of the invention will be apparent from the detailed description and drawings. What follows is merely a description of some preferred embodiments of the present invention. To assess the full scope of the invention, the claims should be looked to as these preferred embodiments are not intended to be the only embodiments within the scope of the claims.

DETAILED DESCRIPTION OF THE PREFERRED EMBODIMENTS

Figure 1:
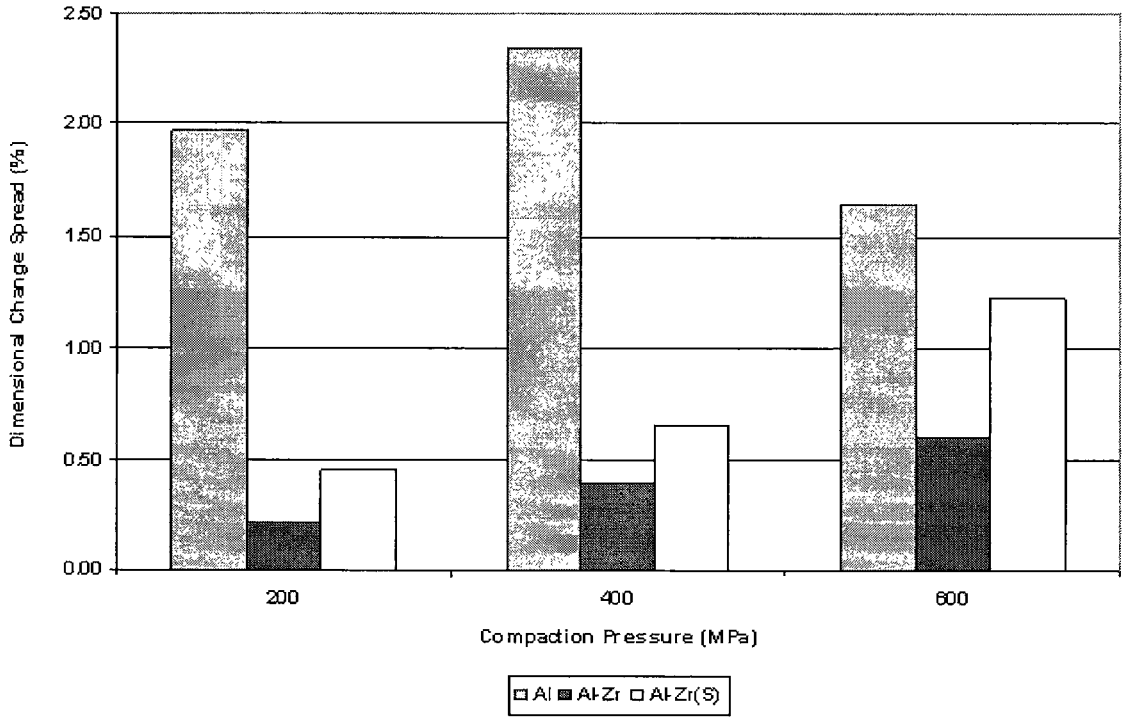
FIG. 1 is a chart showing the dimensional change spread for a number of sintered samples made from different powder formulations of a Al-2.3Cu-1.6Mg-0.2Sn alloy at various compaction pressures.

A number of powder metal samples were produced having various chemistries for comparison purposes. As a baseline system for comparison, a blend designated A36 was used. The formulation for the A36 blend is found in Table I below.

TABLE I

| Powder | Weight Percentage |
|---|---|
| Al | 84.8 |
| Al—Cu (50-50) Master alloy | 5.9 |
| Atomized Mg | 1.5 |
| Sn | 0.6 |
| AlN | 5.8 |
| Licowax C | 1.5 |

The Licowax C is a lubricant material and boils off during heating. Thus, the total mass of powder for a 1 kg lot will actually exceed 1 kg because of the additional mass of the Licowax C constituent.

A modified form of the A36 powder formulation was also produced which will be referred to in this application as E36-Zr. The E36-Zr powder formulation is identical to the A36 blend, except that the aluminum powder is replaced with an air atomized zirconium-doped aluminum powder metal having 0.2% by weight zirconium. The formulation for the E36-Zr blend is found in Table II below.

TABLE II

| Powder | Weight Percentage |
|---|---|
| Al—0.2Zr | 84.8 |
| Al—Cu (50-50) Master alloy | 5.9 |
| Atomized Mg | 1.5 |
| Sn | 0.6 |
| AlN | 5.8 |
| Licowax C | 1.5 |

Notably, the E36-Zr powder blend includes a zirconium-doped aluminum powder with 0.2 wt % zirconium. Conventionally, when alloying elements, such as zirconium are added to a powder blend, these alloying elements are added as part of either an elemental powder (i.e., a pure powder containing only the alloying element) or as a master alloy containing a large amount of both the base material, which in this case is aluminum, and the alloying element. When a master alloy is used, then to obtain the desired amount of the alloying element in the final part, the master alloy will then be "cut" with an elemental powder of the base material. This cutting technique is used, for example, to obtain the desired amount of copper in each of the A36 powder using the Al—Cu(50-50) master alloy and elemental aluminum powder.

In contrast, the zirconium-doped aluminum powder metal is obtained by air or gas atomizing an aluminum zirconium melt containing the desired final composition of zirconium. Air atomizing the powder becomes problematic at higher zirconium concentrations and so it may not be possible to atomize zirconium-doped powders having high weight percentages of zirconium (believed at this time to exceed 2 weight percent zirconium, but this value may be as high as 5 weight percent zirconium).

The addition of zirconium results in the formation of intermetallics, such as $Al_3Zr$, that strengthen the alloy and that remain stable over a range of temperatures. If the zirconium was added as an elemental powder or as part of a master alloy, then the intermetallic phase would be formed preferentially along the grain boundaries and would be coarse in size since relatively slow diffusion kinetics prevent zirconium from being uniformly distributed within the sintered microstructure. Under those conditions, the intermetallic phase imparts only limited improvement in the properties of the final part.

Figure 9:
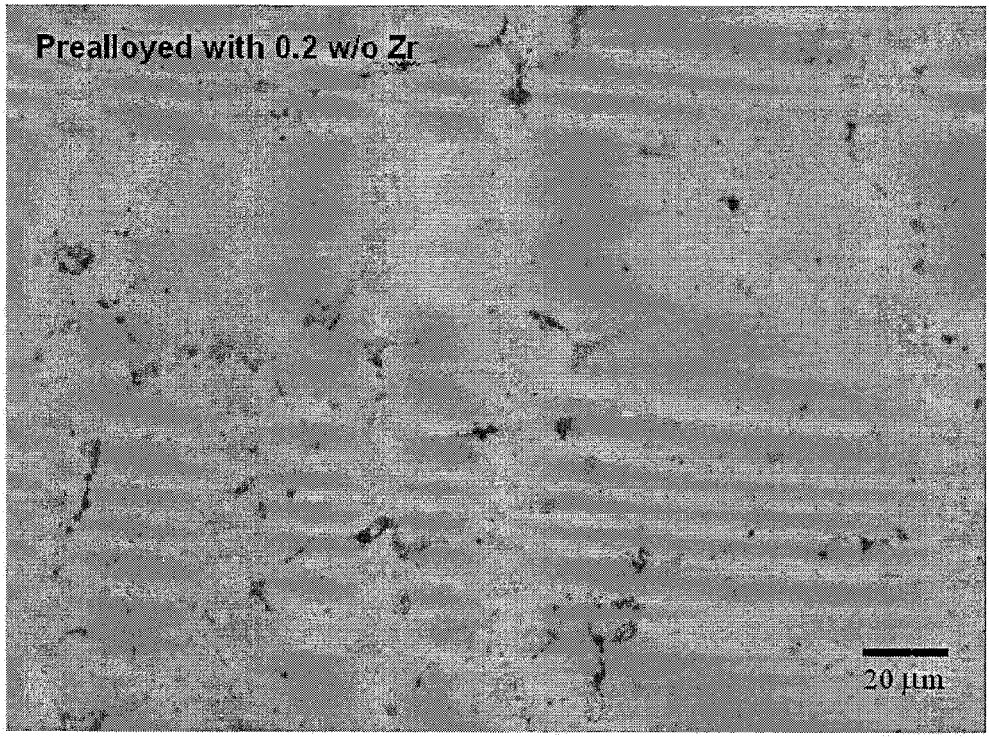
FIG. 9 is an optical micrograph of Al-2.3Cu-1.6Mg-0.2Sn-0.2Zr produced using aluminum powder prealloyed with 0.2 weight percent zirconium.
Figure 10:
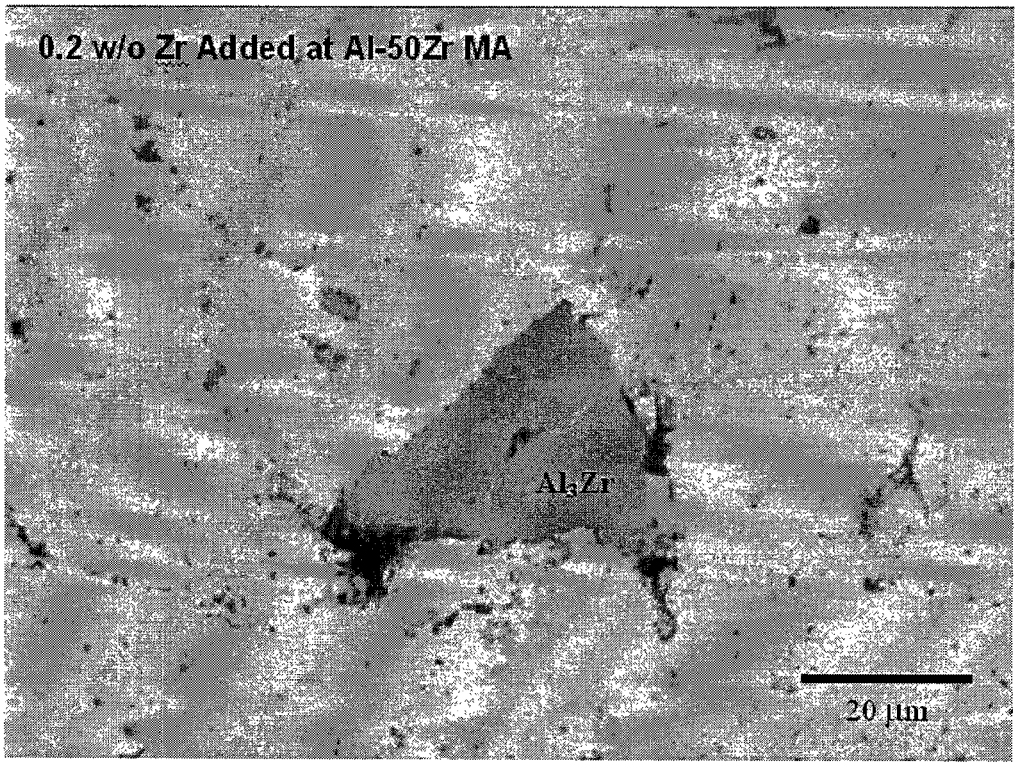
FIG. 10 is an optical micrograph of Al-2.3Cu-1.6Mg-0.2Sn-0.2Zr produced with zirconium introduced in an aluminum—zirconium (50-50) master alloy powder.
Figure 11:
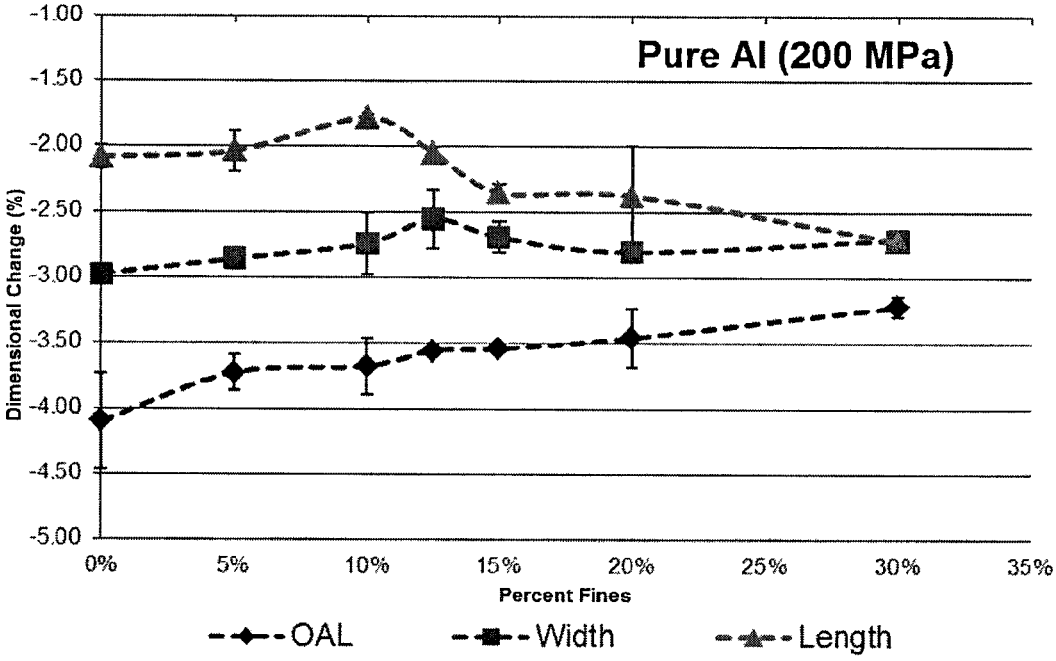
FIGS. 11 through 14 are graphs illustrating the effect of percent fines in the powder metal on the dimensional change percent for pure aluminum, aluminum doped with 0.05 weight percent zirconium, aluminum doped with 0.2 weight percent zirconium, and aluminum doped with 0.5 weight percent zirconium.
Figure 12:
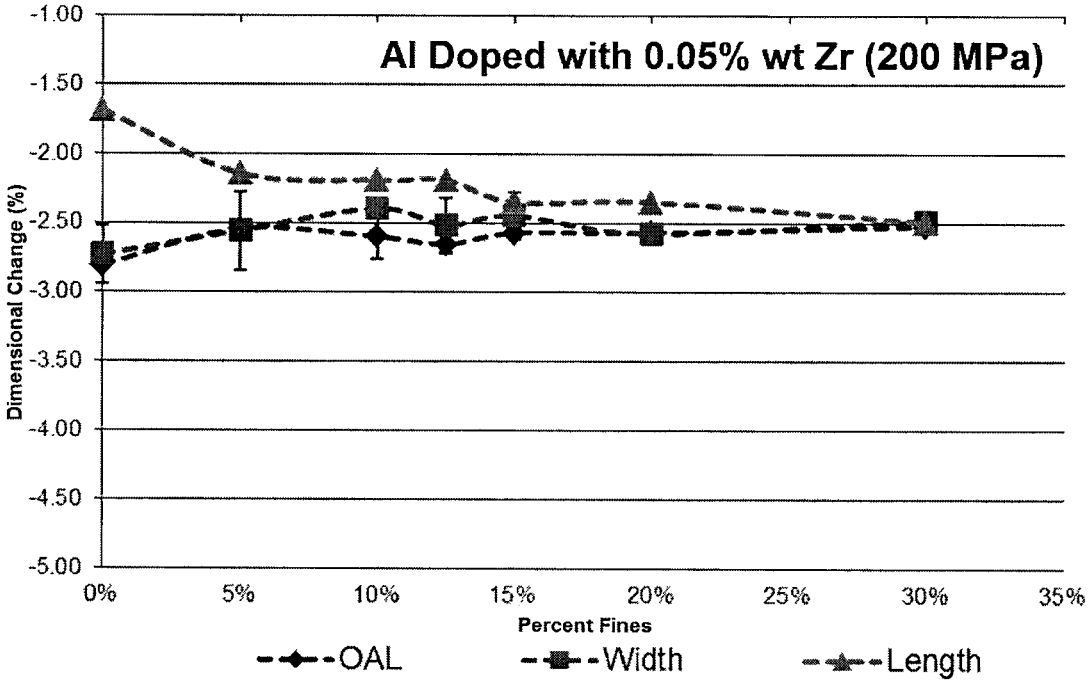
Figure 13:
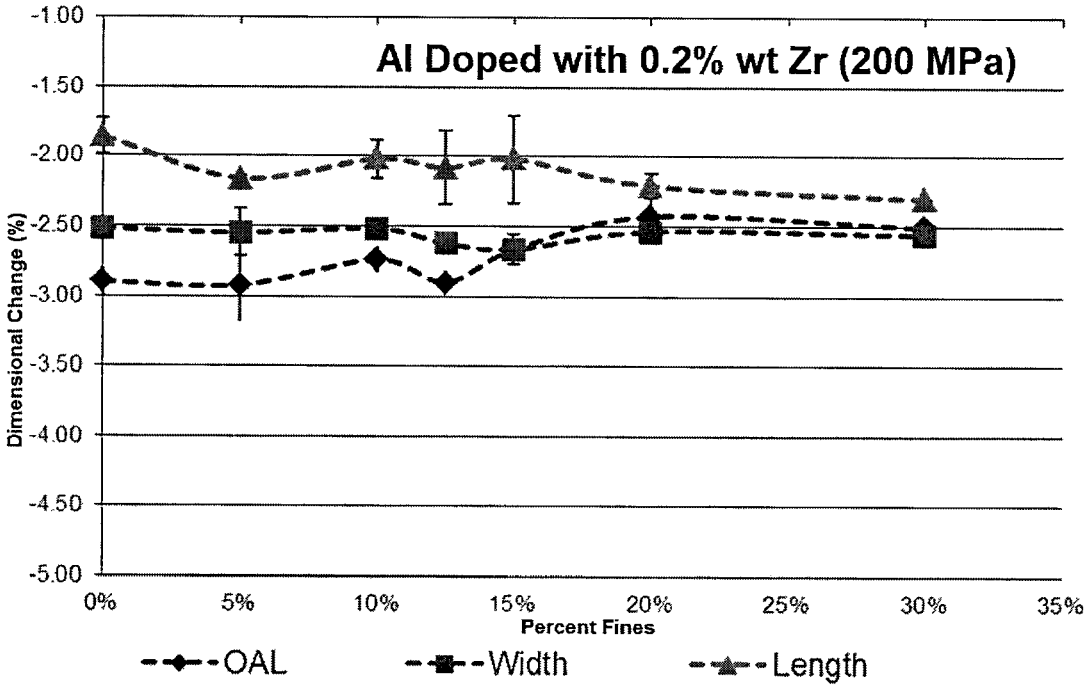
Figure 14:
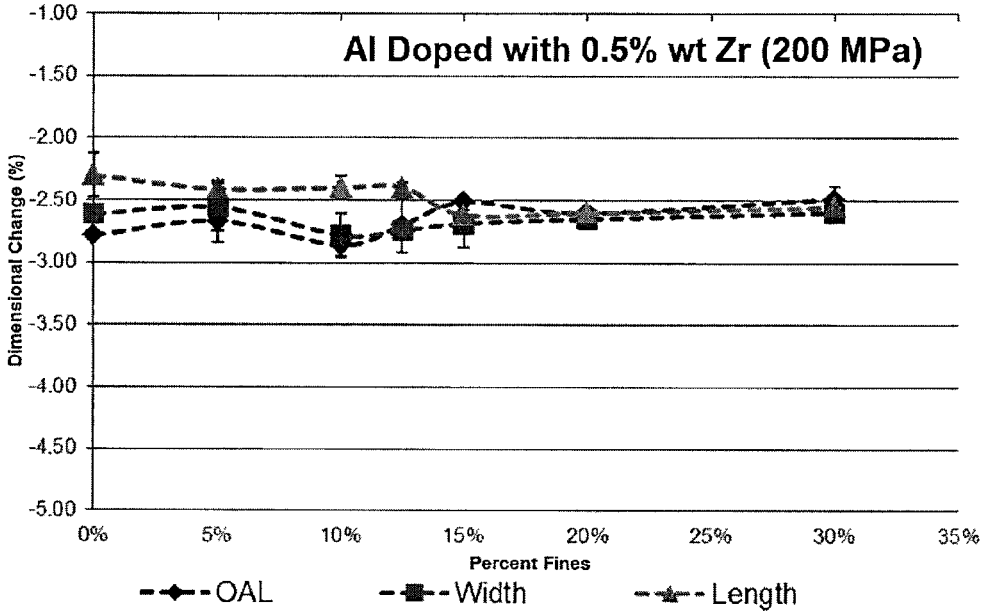

By doping the zirconium in the aluminum powder, rather than adding the zirconium in the form of an elemental powder or as part of a master alloy, the zirconium is more evenly and homogeneously dispersed throughout the entire powder metal as illustrated by a comparison of FIG. 9 (Zr prealloyed) and FIG. 10 (Zr in a master alloy). Thus, the final morphology of the a zirconium-doped part will have the zirconium placed throughout the aluminum and the intermetallics will not be relegated or restricted to placement primarily along the grain boundaries at which they are of only limited effectiveness.

The A36 and E36-Zr powders were made into test bars. Each of the powders were compacted at various compaction pressures (either 200 MPa or 400 MPa) into test bar samples, sintered, and then given a T6 temper heat-treatment. After heat treatment, the various mechanical properties were tested and compared to one another. Table III, below, summarizes the results of the various tests.

TABLE III

| Powder Blend | Compaction Pressure (MPa) | Average Yield Strength (MPa) | Average UTS (MPa) | Average Elongation (%) | Average Young's Modulus (GPa) |
|---|---|---|---|---|---|
| A36 | 200 | 285 | 288 | 0.72 | 57 |
| A36 | 400 | 293 | 295 | 0.65 | 62 |
| E36-Zr | 200 | 312 | 346 | 2.01 | 64 |
| E36-Zr | 400 | 322 | 357 | 2.24 | 65 |

As can be seen above in Table III, the 0.2 weight percent zirconium doping improved the average yield strength, the average ultimate tensile strength, the average elongation, and the average Young's modulus of the test samples. Notably, the observed elongation in the zirconium-doped aluminum samples was much higher and was similar to the control ductility observed in typical T1 temper heat treated samples. Further, the yield strength and the ultimate tensile strength also improved noticeably with the additional zirconium doping.

The changes in various physical characteristics were also measured between the as-compacted and the as-heat treated samples. Table IV below lists the average changes in mass, the average sintered density, the average change in various sample dimensions, and the average T6 hardness.

TABLE IV

| Powder Blend | Compact. Pressure (MPa) | Mass Change (%) | Sint. Den. (g/cc) | Dimensional Change (%) Length | Width | OAL | T6 Hardness (HRB) |
|---|---|---|---|---|---|---|---|
| A36 | 200 | −1.33 | 2.721 | −1.64 | −2.42 | −3.18 | 67.2 |
| A36 | 400 | −1.32 | 2.723 | −0.73 | −1.29 | −1.91 | 71.3 |
| E36-Zr | 200 | −1.38 | 2.751 | −2.48 | −3.06 | −4.24 | 72.9 |
| E36-Zr | 400 | −1.40 | 2.745 | −1.27 | −1.66 | −2.25 | 73.3 |

Table IV indicates that the E36-Zr samples exhibited more isotropic shrinkage than the Ampal A36 control samples. This means that there was less distortion in the samples prepared using the zirconium-doped aluminum than in the samples prepared without any zirconium.

Referring now to FIG. 1, the dimensional spread change for various powder samples at various compaction pressures were determined. The "Al" measurements refer to samples made from pure aluminum powder (i.e., the A36 formulation); the "Al—Zr" measurements refer to samples made from 0.2 weight percent zirconium-doped aluminum samples (i.e., the E36-Zr formulation); and the "Al—Zr(S)" samples refer samples made using the zirconium-doped aluminum, but in which the zirconium doped aluminum was screened at to only include particles greater than 45 micrometers (approximately 325 mesh size). FIG. 1 illustrates that at any of the 200 MPa, 400 MPa, and 600 MPa compaction pressures, the samples made from the zirconium-doped aluminum powder unscreened have the most consistent dimensional change of the three sample powders.

Figure 2:
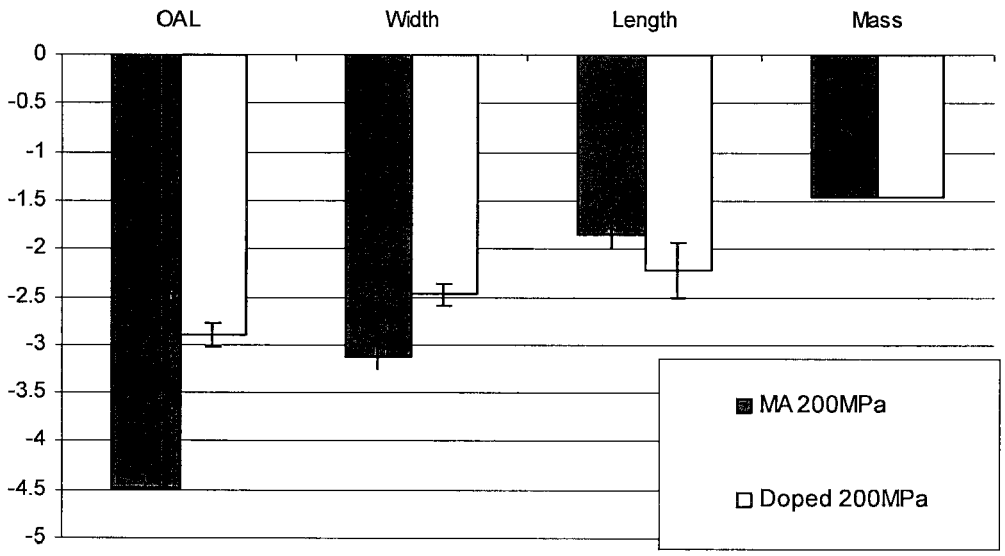
FIG. 2 is a chart comparing the dimensional and mass changes during sintering between Al-2.3Cu-1.6Mg-0.2Sn samples made of (1) an Al—Zr (50/50) master alloy powder blended with aluminum powder and (2) a zirconium-doped aluminum powder at 200 MPa compaction pressure.
Figure 3:
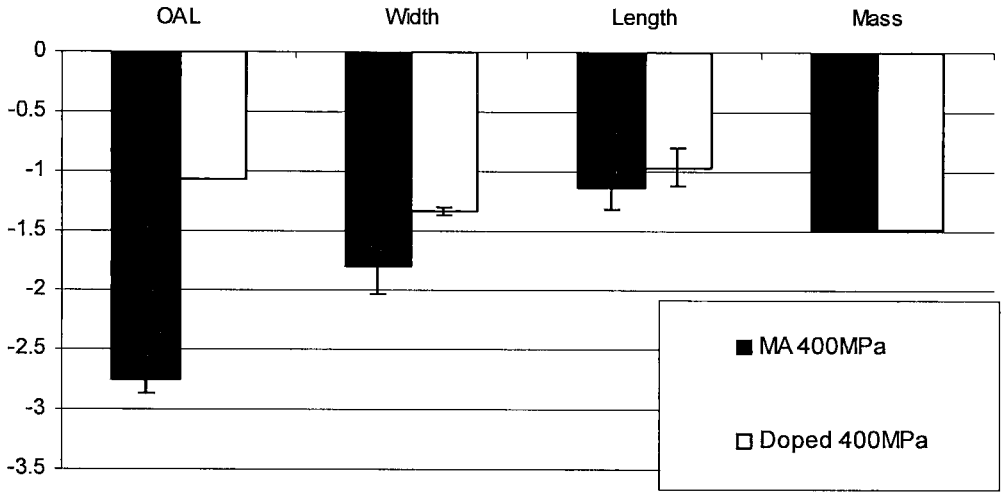
FIG. 3 is a chart similar to FIG. 2, but in which the samples were compacted at a compaction pressure of 400 MPa.

Referring now to FIGS. 2 and 3, two charts are provided which comparatively indicate the dimensional and the mass changes in two different Al-2.3Cu-1.6Mg-0.2Sn powders each having 0.2 weight percent zirconium in aluminum. One of these powders was prepared from a master alloy powder blended with a pure aluminum base powder to reach the desired zirconium content and the other powder prepared was the zirconium-doped aluminum powder made by air atomization of an aluminum—zirconium melt. FIG. 2 compares the changes for the powders at a 200 MPa compaction pressure while FIG. 3 compares the powders at a 400 MPa compaction pressure. In both FIGS. 2 and 3, it can be seen that the zirconium-doped aluminum powder has more consistent shrinkage across the various dimensions (i.e., overall length, width, and length) even though the mass change is equal. This is indicative that the parts made from the zirconium-doped aluminum powder exhibit less distortion than the parts made from the powder including the aluminum—zirconium master alloy.

Moreover, a comparison of FIGS. 2 and 3 to one another indicates that the greater the compaction pressure, the less the dimensional change will be in the samples. This makes logical sense as the parts having the higher compaction pressure will have a greater green density and shrink less upon sintering.

Figure 4:
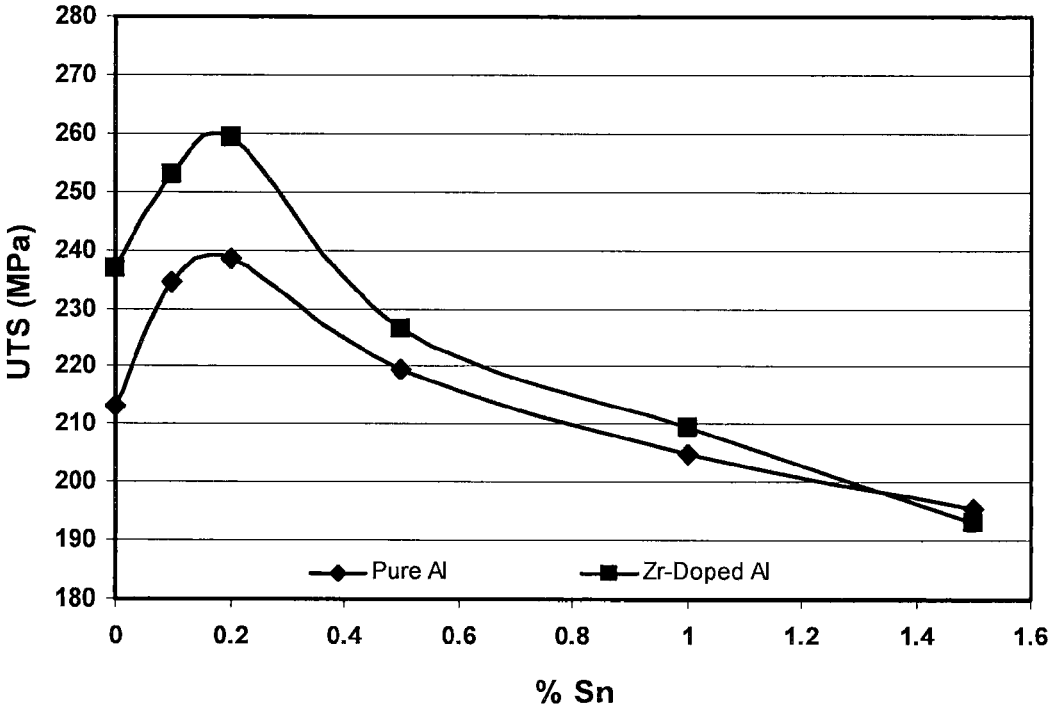
FIGS. 4 through 7 are graphs comparing the ultimate tensile strength (UTS), elongation, and Young's modulus of parts made from Al-2.3Cu-1.6Mg powder metals containing pure aluminum and aluminum doped with 0.2 wt % zirconium having various tin compositions.
Figure 5:
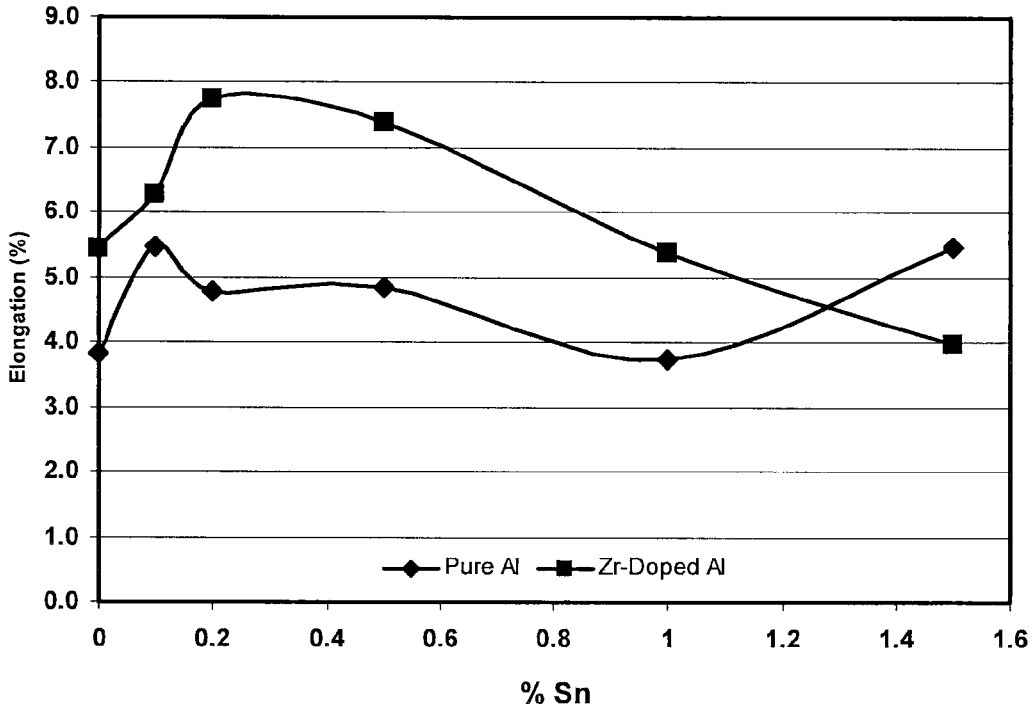

Referring now to FIGS. 4 and 5, the ultimate tensile strength and the percent elongation of Al-2.3Cu-1.6Mg powders made from a pure aluminum powder and a zirconium-doped aluminum powder were measured with various amounts of elemental tin added. From a review of these figures, it can be seen that the greatest ultimate tensile strength is obtained when approximately 0.2 weight percent of tin is added. At 0.2 weight percent tin, tensile testing indicates that the zirconium-doped aluminum material has a peak ultimate tensile strength of approximately 260 MPa and just under 8 percent elongation before fracture. At lower or higher tin additions, the ultimate tensile strength and ductility of the material decreases from these peak values.

Figure 6:
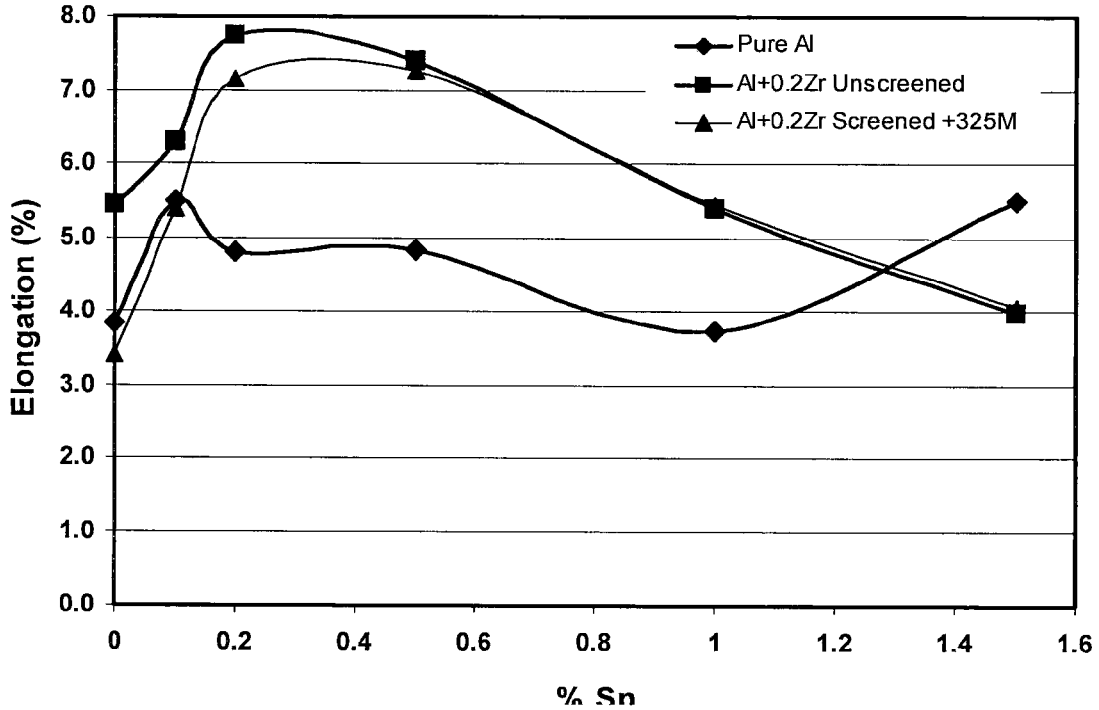
Figure 7:
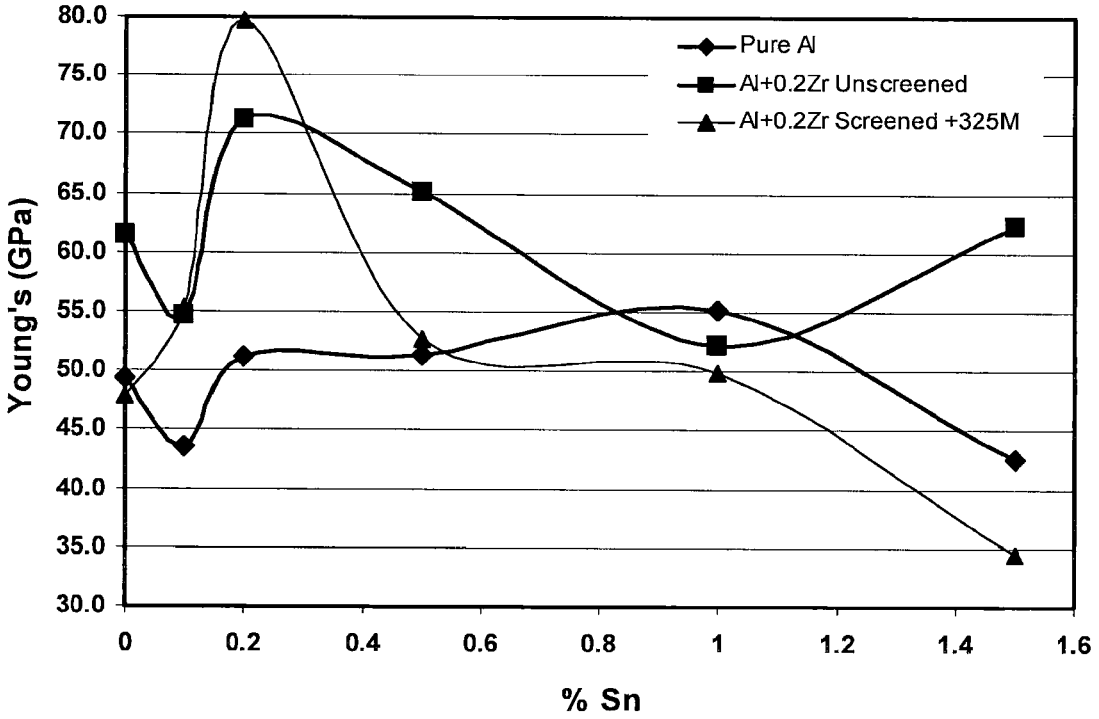
Figure 8:
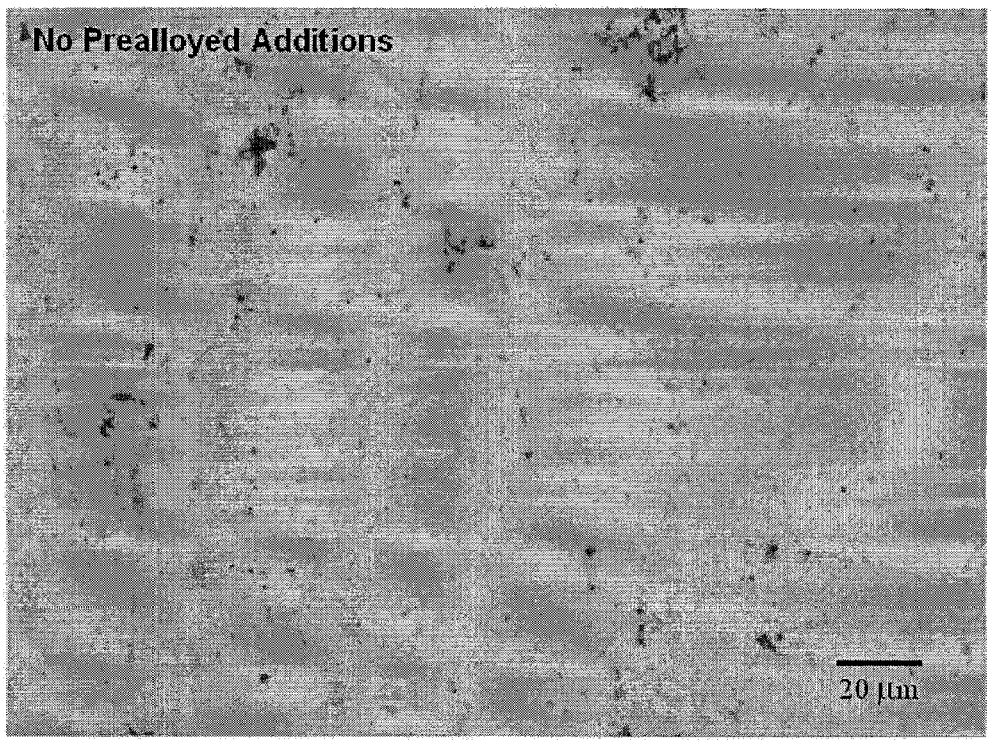
FIG. 8 is an optical micrograph of Al-2.3Cu-1.6Mg-0.2Sn produced using pure aluminum as the base powder with no prealloyed zirconium.

Looking at FIGS. 6 and 7, the elongation and Young's modulus of various Al-2.3Cu-1.6Mg powders are compared at various elemental tin additions. Tin was added as an elemental powder to a Al-2.3Cu-1.6Mg powder formulation made from a pure aluminum powder, a 0.2 weight percent zirconium-doped aluminum powder unscreened, and a 0.2 weight percent zirconium-doped aluminum powder screened though at +325 mesh.

The most notable observation is that when 0.2 weight percent tin was added to the 0.2 weight percent zirconium-doped aluminum powder (screened at +325), a Young's modulus of almost 80 GPa was observed. A Young's modulus in the range of 70 to 80 GPa is comparable to that of a wrought alloy of the same constituents. For most sintered aluminum alloys, a Young's modulus typically falls in the range of 50 to 65 GPa. Accordingly, finding a powder composition that has a Young's modulus of this magnitude was unexpected and surprising.

Although some formulas have been detailed above, it will be appreciated that the zirconium-doped aluminum powder may be mixed with additional alloying elements as well. Tables V-VII below provide powder formulations of a 431D-AlN—Zr powder, a 7068-AlN—Zr powder, and a 431D-SiC—Zr powder, respectively.

TABLE V

| Powder | Weight Percentage |
|---|---|
| Al—0.2Zr | 22.5 |
| Al—Zn—Mg—Cu—Sn master alloy | 70.3 |
| AlN | 5.7 |
| Licowax C | 1.5 |

TABLE VI

| Powder | Weight Percentage |
|---|---|
| Al—0.2Zr | 43.9 |
| Al—Zn—Mg—Cu—Sn Master alloy | 43.9 |
| Zn | 3.6 |
| Atomized Mg | 0.8 |
| Cu | 0.7 |
| Sn | 0.1 |
| AlN | 5.6 |
| Licowax C | 1.5 |

TABLE VII

| Powder | Weight Percentage |
|---|---|
| Al—0.2Zr | 22.5 |
| Al—Zn—Mg—Cu—Sn master alloy | 70.4 |
| SiC | 5.6 |
| Licowax C | 1.5 |

The Al—Zn—Mg—Cu—Sn master alloy is 85.9 wt % Al, 2.64 wt % Cu, 3.48 wt % Mg, 7.74 wt % Zn, and 0.24 wt % Sn.

In these formulations, the zirconium-doped aluminum powder is blended with other powders including master alloys, elemental powders, and ceramic strengtheners to further target specific mechanical properties. However, in each of these blends, it should be noted that the primary source of zirconium is the zirconium-doped aluminum alloy.

Referring now to FIGS. 11 through 15, the effect of fines on the dimensional change of the powder metal is illustrated. Percent fines is the percentage of material in aggregate finer than a given sieve, which in this instance is a −325 mesh with 44 micron openings. For testing, powder metals having 0, 5, 10, 12.5, 15, 20 and 30 percent fines were made of pure aluminum and aluminum doped with 0.05, 0.2, and 0.5 weight percent zirconium, compacted into test samples at 200 MPa compaction pressure, and then sintered under similar thermal conditions. The dimensional change in overall length (OAL), width, and length were measured between the compacted and sintered parts.

FIGS. 11 through 14 show that test samples made from powder metals having a higher percentage of fines have dimensional change percentages that converge to a similar value in each of the various measured dimensions (i.e., OAL, width, and length). This was true in both the pure aluminum sample and zirconium-doped samples, although the zirconium-doped samples exhibit a reduced range of dimensional change across the various measured sample dimensions. For the zirconium-doped aluminum samples, the various dimensional change percentages converged to approximately −2.5% as percent fines increased. Although the pure aluminum sample dimensional changes also trended toward one another, even at 30 weight percent fines, there was still a comparably large dimensional change range (approximately 0.5%) across the various measured dimensions in comparison to the zirconium-doped powder metals.

Figure 15:
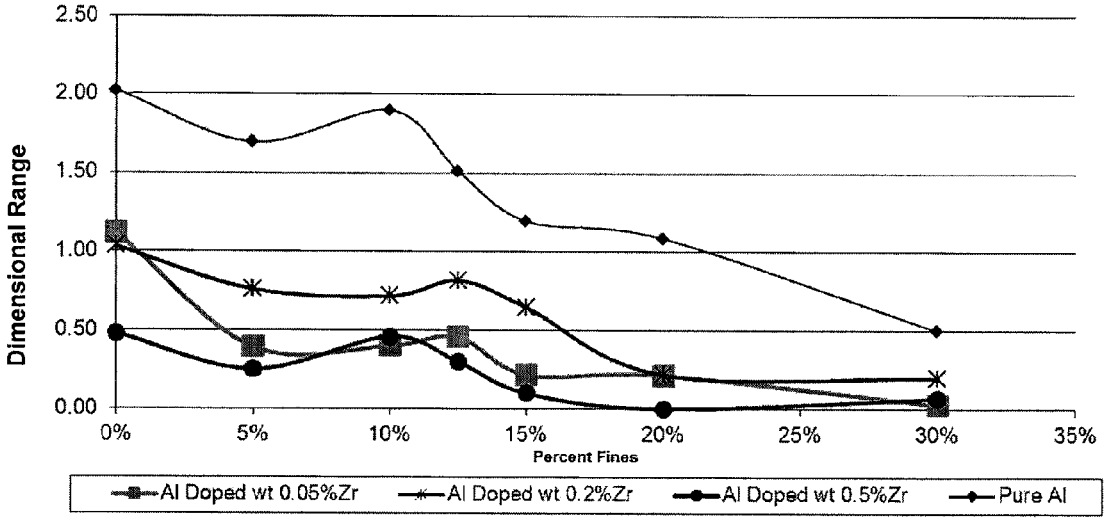
FIG. 15 is a graph illustrating the dimensional change percent range for each of the powder metal compositions shown in FIGS. 11 through 14 at various percent fines.

FIG. 15 provides a summary of the ranges between the measured dimensions for each powder metal at the various fine percentages. This chart reveals that zirconium doping of aluminum improves dimensional stability and that increased amounts of fines can further enhance this dimensional stability.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A method of producing a powder metal part, the method comprising:

forming an aluminum—zirconium melt in which a zirconium content of the aluminum—zirconium melt is less than 2.0 percent by weight;

powderizing the aluminum—zirconium melt to form a zirconium-doped aluminum powder metal;

mixing the zirconium-doped aluminum powder metal with at least one other powder metal including tin thereby forming a mixed powder metal; and compacting and sintering the mixed powder metal to form the powder metal part;

wherein a quantity of zirconium in the powder metal part is substantially equal to a quantity of zirconium found in the zirconium-doped aluminum powder metal used to form the powder metal part.

2. The method of claim 1, wherein the step of powderizing includes air atomizing the aluminum—zirconium melt.

3. The method of claim 1, wherein powderizing the aluminum—zirconium melt to form a zirconium-doped aluminum powder metal includes at least one of atomizing with a gas, as well as comminution, grinding, chemical reaction, and electrolytic deposition.

4. The method of claim 1, wherein the zirconium-doped aluminum powder metal inhibits distortion of the powder metal part during a sintering process used to form the powder metal part.

5. The method of claim 1, wherein the powder metal part includes zirconium in an amount of less than 2.0 weight percent.

6. The method of claim 1, wherein the tin is added as an elemental powder to the zirconium-doped aluminum powder metal.

7. The method of claim 1, wherein the tin is added as a prealloy in a master alloy.

8. The method of claim 1, wherein the tin is approximately 0.2 percent by weight of the mixed powder metal.

9. The method of claim 8, wherein the powder metal part made from the mixed powder metal has a Young's modulus above 70 GPa.

10. The method of claim 1, wherein at least one ceramic additive is added up to 15 volume percent.

11. The method of claim 10, wherein the at least one ceramic additive includes at least one of SiC and AlN.

12. The method of claim 1, wherein the powder metal part formed by the step of compacting has a shape corresponding to the shape of the powder metal part after the step of sintering, except that the shape of powder metal part after the step of sintering is dimensionally smaller than the shape of powder metal part before the step of sintering.

13. The method of claim 12, wherein the powder metal part that is compacted and sintered from the zirconium-doped aluminum powder metal exhibits less distortion from shrinkage during the sintering step than a comparable powder metal part that is compacted and sintered from an aluminum powder metal without zirconium doping.

* * * * *